US005606775A

United States Patent [19]

Dame

[11] Patent Number: 5,606,775

[45] Date of Patent: Mar. 4, 1997

[54] TWO IN ONE HINGE

[76] Inventor: Robert A. Dame, 23 Bluemer Rd., Southampton, Mass. 01073

[21] Appl. No.: 353,719

[22] Filed: Dec. 12, 1994

[51] Int. Cl.[6] ..... E05D 5/02

[52] U.S. Cl. ..... 16/387

[58] Field of Search ..... 16/387, 384, 385, 16/388, 247, 248

[56] References Cited

U.S. PATENT DOCUMENTS 5,058,236 10/1991 Henson ..... 16/387

*Primary Examiner*—Chuck Y. Mah
*Attorney, Agent, or Firm*—Deborah A. Basile

[57] ABSTRACT

An improvement on hinges such that the side of the hinge which comes into contact with the door or door jamb is scored so as to remove a portion of the square hinge corners on the back side of the hinge to insert into a rounded hinge cut-out. The Two in One Hinge eliminates the need to manufacture rounded hinges. It eliminates the need to square off rounded hinge cut-outs so as to install a square corner hinge. It eliminates the need for the installer to utilize hand tools to square off the corners of a round hinge cut-out.

1 Claim, 3 Drawing Sheets

TWO IN ONE HINGE

TECHNICAL FIELD

The invention relates to square corner hinges.

I. BACKGROUND OF THE INVENTION

The construction, millwork and furniture industries use both round and square door hinges. The invention consists of an improvement for a hinge whereby the back side of the four square corners of the hinge are scored and a portion of the metal comprising the corner of the hinge is removed so that the square corner hinge can be installed into a rounded hinge cut-out in the door frame or door, or other means for installation such as folding partitions and furniture. It has been time consuming and costly for contractors to conform a rounded hinge cut-out to fit a full square corner hinge. Various tools have been adapted by contractors to perform this function, each of which is costly and inefficient. The present invention eliminates the need for a contractor to use an additional tool to make a rounded hinge cut-out square. A solution to this problem is to use a square hinge which is scored such that it can easily be placed in a rounded hinge cut-out and with a couple of taps of a hammer on the outside of the hinge, the squared portion of the hinge can be securely placed in the rounded hinge cut-out. The advantage of this invention is that it eliminates the need to manufacture round corner hinges because square hinges with this adjustment can be used in round corner hinge cut-out installations. As stated, it also eliminates the need for the installer to use additional tools to square out a rounded hinge cut-out and also to spend the time to perform this needless, expensive task.

II SUMMARY OF THE INVENTION

A hinge made of metal or similar material in any different size which has two sides, one of which comes in contact with the door or door jamb and one of which faces the exterior of the door. The hinge which comes in contact with the door or jamb has four corners, each of which is machined to reduce the thickness and the corner is removed such that the side of the door hinge which comes in contact with the door or door jamb hinge cut-out that has round corners.

The side of the door hinge which comes in contact with the door or door jamb will fit securely into a rounded hinge cut-out in the door or door jamb and the squared overlapping hinge corner from the exterior side can be tapped easily into the door or door jamb hinge cut-out. The "Two in One Hinge" will eliminate the need to manufacture round corner hinges. The "Two in One Hinge" will eliminate the need for wholesalers and retailers to stock round corner hinges. The "Two in One Hinge" will install easily into a round corner electrical router cut-out without the need for any handwork or any additional tools to be used by the installer. The "Two in One Hinge" can be used in soft or hard wood and effectuates a professional installation job. The "Two in One Hinge" can also be used in steel or wood jambs and doors which have square cut-outs.

III BRIEF DESCRIPTION OF THE DRAWINGS

IV DESCRIPTION OF THE PREFERRED EMBODIMENT

Figure 1:
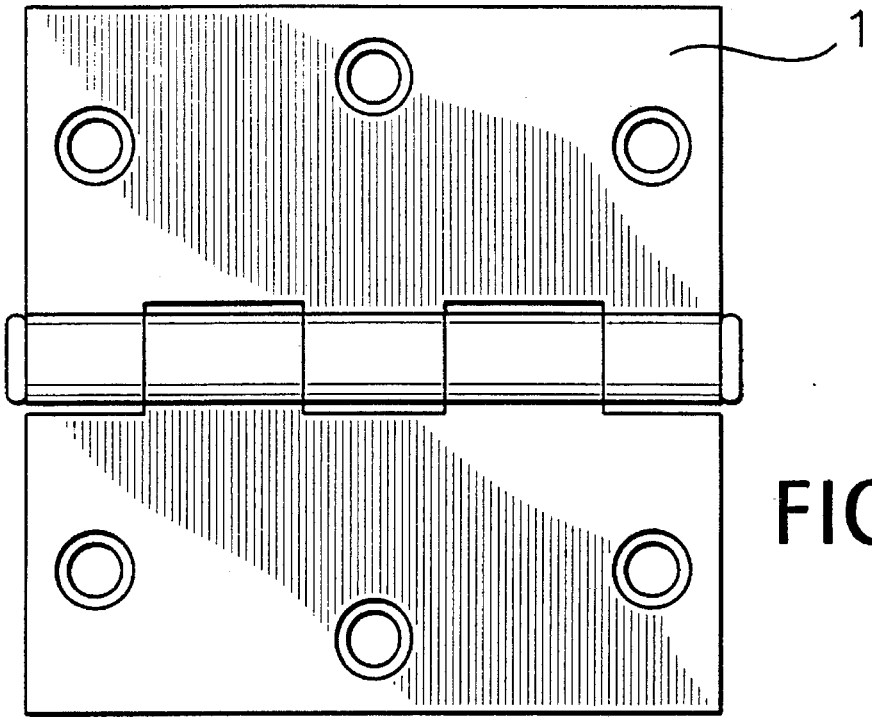
FIG. 1 is a view of the face side of the "Two in One Hinge".
Figure 2:
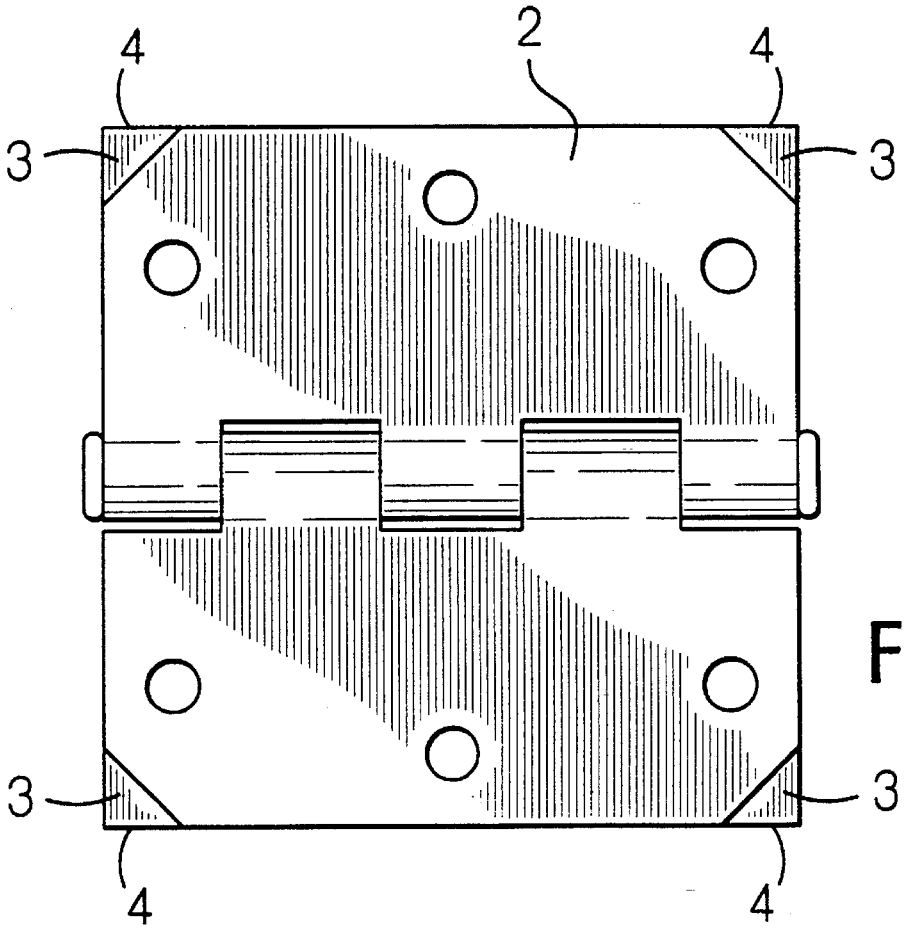
FIG. 2 is a view of the back side of the "Two in One Hinge" which comes in contact with the door or door jamb or other installation.
Figure 3:
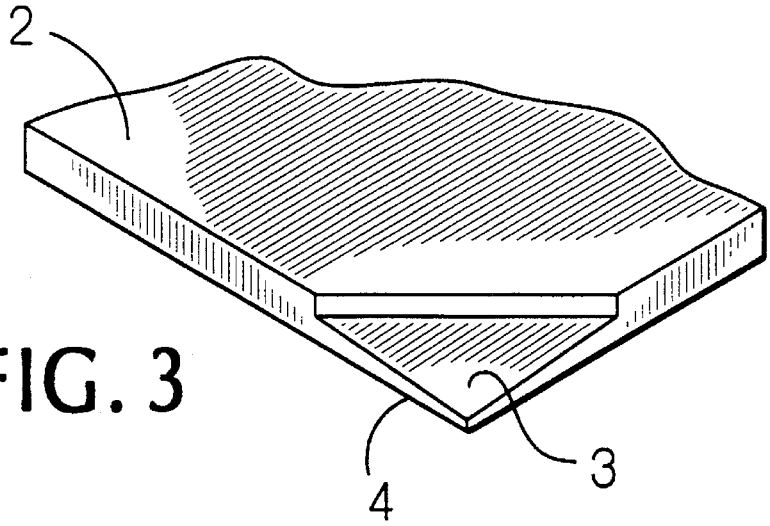
FIG. 3 is a detailed view of one corner of the back side of the "Two in One Hinge".
Figure 4:
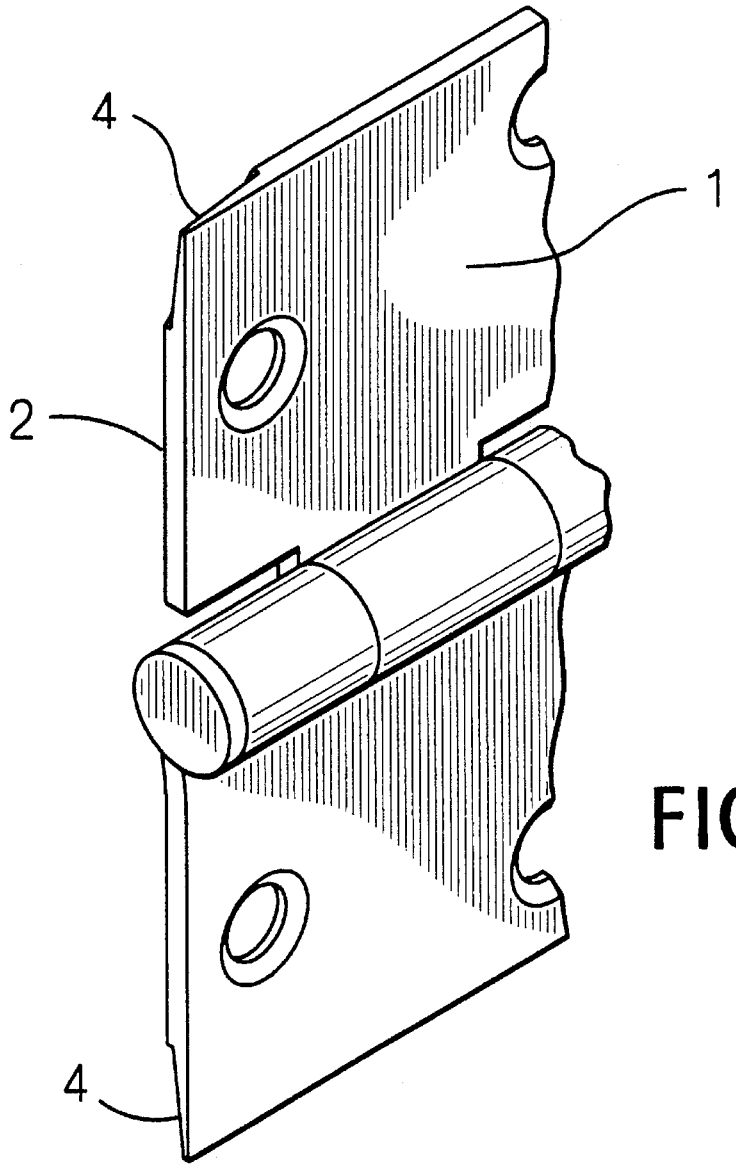
FIG. 4 is an end view showing the back side and the face side of a "Two in One Hinge".
Figure 5A:
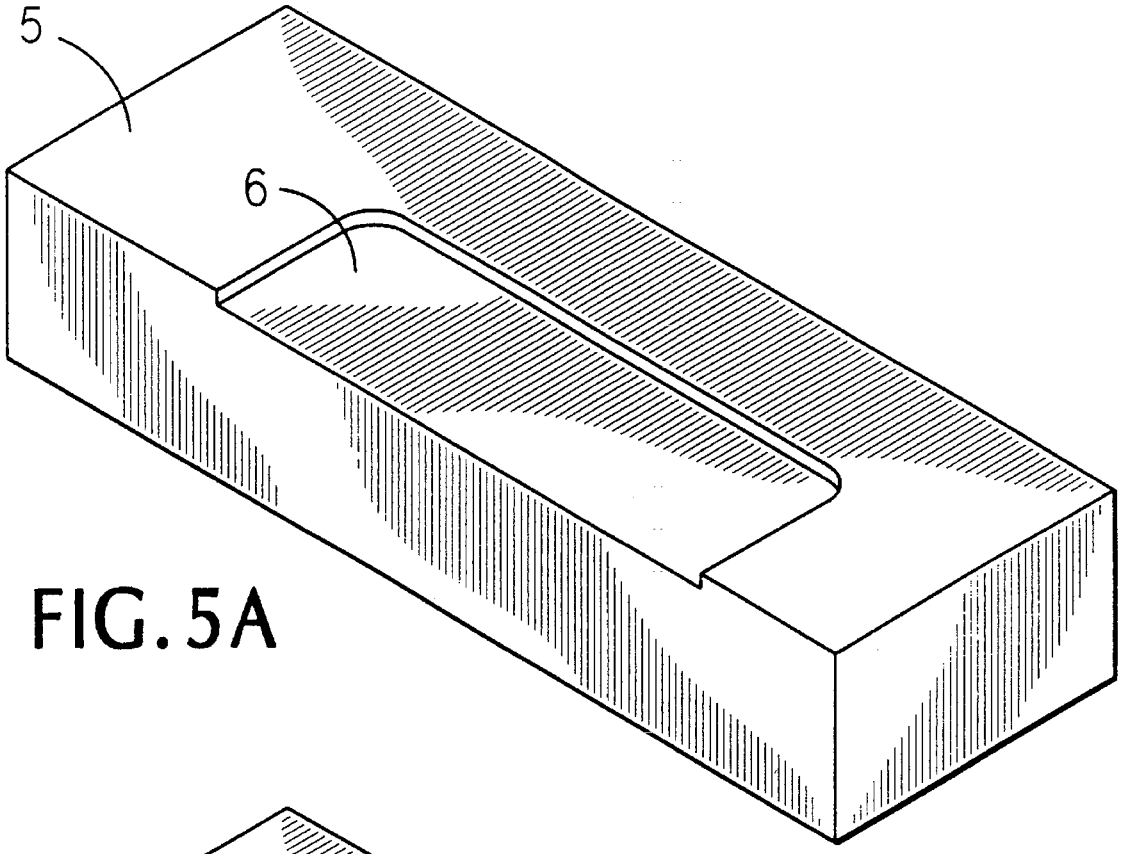
FIG. 5 is a view of the door and door jamb showing the rounded router hinge cut-out in the door or door jamb and also showing the finished installation of the "Two in One Hinge" into hinge cut-out.
Figure 5B:
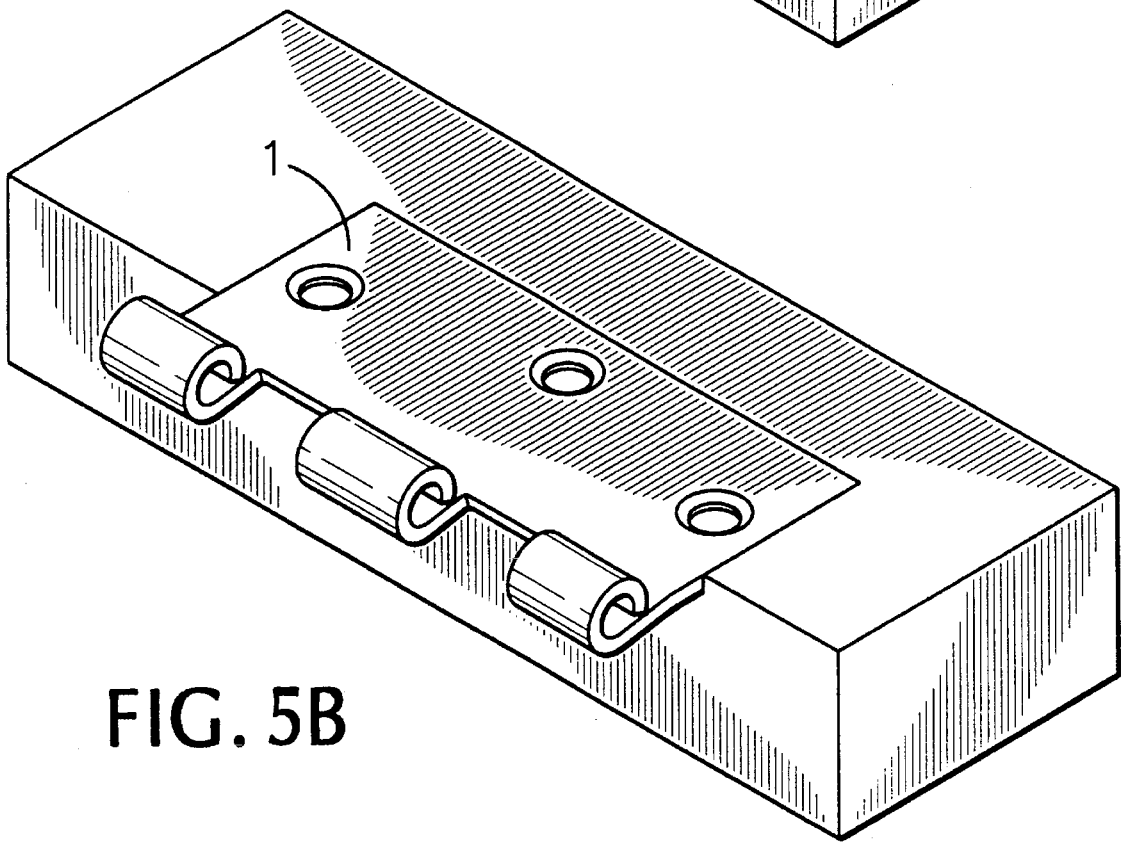

According to FIGS. 1 and 2, the "Two in One Hinge" has a face side (1) and a back side (2), which back side comes in contact with the door or door jamb. Referring to FIG. 2, the back side (2) has four corners in each corner there is a groove which is scored (3) to reduce the thickness of the hinge and the scored section is removed. Each corner then has a triangular (or any similar shaped) protrusion (4) which once installed will cover the outside of the rounded router hinge cut-out (6) in the door (5) or door jamb, or other installation.

Having described the preferred embodiment of the invention with reference to the accompanying drawings, it is to be understood that the invention is not limited to that precise embodiment and that various changes and modifications may be effected therein by one skilled in the art without departing from the scope or spirit of the invention as defined in the appended claim.

We claim:

1. A hinge, comprising:

a hinge pin;

a first half having one or more holes therethrough for mounting to a door or a door jamb and a first plurality of receptacles for receiving said hinge pin;

a second half having one or more holes therethrough for mounting to said door or the door jamb and a second plurality of receptacles for receiving said hinge pin;

said first and second halves each having substantially square corners, said corners having a front side and a back side, said back side of each corner being scored so as to reduce the thickness thereof, said score being substantially triangular for allowing each of said corners for mounting to said door or the door jamb.

* * * * *